US005277614A

United States Patent [19]

Bentz et al.

[11] Patent Number: 5,277,614

[45] Date of Patent: Jan. 11, 1994

[54] ELECTRICAL PLUG CONNECTOR

[75] Inventors: Willy Bentz, Sachsenheim; Waldemar Ernst, Vaihingen/Enz.; Uwe Steinhauser, Filderstadt, all of Fed. Rep. of Germany

[73] Assignee: Robert Bosch GmbH, Stuttgart, Fed. Rep. of Germany

[21] Appl. No.: 884,595

[22] Filed: May 15, 1992

[30] Foreign Application Priority Data

Jun. 10, 1991 [DE] Fed. Rep. of Germany ..... 4119122

[51] Int. Cl.[5] ..... H01R 13/627

[52] U.S. Cl. ..... 439/350; 439/345

[58] Field of Search ..... 439/350–

[56] References Cited

U.S. PATENT DOCUMENTS

| | | | |
|---|---|---|---|
| 2,235,020 | 3/1941 | Jones | 439/352 |
| 3,544,951 | 12/1970 | Roberts | 339/91 |
| 4,166,664 | 9/1979 | Herrman, Jr. | 439/352 |
| 4,632,492 | 12/1986 | Yamada | 439/350 |
| 5,055,065 | 10/1991 | Pearl | 439/592 |

FOREIGN PATENT DOCUMENTS 3531925 3/1987 Fed. Rep. of Germany .

*Primary Examiner*—Gary F. Paumen
*Assistant Examiner*—Hien D. Vu
*Attorney, Agent, or Firm*—Frishauf, Holtz, Goodman & Woodward

[57] ABSTRACT

Securing mechanisms are employed in known plug connections, which have components designed in a complicated way, the manufacture and assembly of which entails high cost and which result in bulky plug connectors. The plug connection in accordance with the invention is designed in such a way that a securing ring (18) formed in one piece on a second part (11) has stop shoulders (29) which, for securing the plug connection, grip, stationary detents (46) of a first part (41). The securing ring (18) has the shape of a convexly closed polygon (24), the corner points (26) of which have a reduced wall thickness in comparison with the polygon lines (27). The polygon lines (27) can be kinked at the corner points (26) by means of squeezing pressure forces acting on the securing ring (18), which allows the disconnection of the securing of the plug connection. This results in a plug connection of low mass which can be manufactured in a cost-effective manner. This plug connection is preferably employed in motor vehicles which are subject to oscillation increases during operation.

17 Claims, 1 Drawing Sheet

ELECTRICAL PLUG CONNECTOR

CROSS-REFERENCE TO RELATED DOCUMENTS

German Patent DE 35 31 925, published 19 MAR. 1987, issued 1988.

FIELD OF THE INVENTION

The invention relates to an electrical plug connection having a first part consisting of plastic for receiving plug-in contacts and a second part, also consisting of plastic, the first of these parts having at least one rigid locking shoulder, and the second part having at least one locking shoulder disposed on a resilient element of said second part which, when the parts are plugged into each other, grips the rigid locking shoulder from behind, the resilient element being deformable via an actuation part in such a way that the locking shoulder on the resilient part can be removed from the position where it grips the rigid locking shoulder from behind.

BACKGROUND

In electrical plug connections consisting of a first part and a second part adapted to the first and formed as a connecting part, it is known to provide catches which prevent the unintentional disconnection of the plug connection.

As a rule, these catches are formed as resilient elements such as springs, hooks and the like, which grip locking elements from behind.

In case of great mechanical stress of this plug connection, for example in a plug connection installed in a motor vehicle, it is necessary to form the elements required for these catches stronger, so that disconnection of the plug connection, due to the considerable mechanical stresses on the plug connection during operation of the motor vehicle, is prevented.

An electrical plug connection with a U-shaped securing spring made of wire and seated on a connecting part, which grips a detent of a first part inserted in the connecting part, is known from German Patent Disclosure DE-35 31 925 C2, HAKE, published 19 MAR. 1987. The securing spring is a complicated bent component of spring wire having two spring legs, each one of the spring legs forming a two-armed lever, and securing sections with a support section and a manipulation section being formed on the levers.

A component of this type is encumbered with many interdependent tolerances and, in a bendable part, the wire diameter of which is relatively large in comparison with the individual bending sections and for this reason is very stiff per se, this results in high production costs because of complicated tools and large testing expenditures. To prevent lasting deformations which would lead to widening of the U-shape of the spring and would endanger locking, the spring must be guided through support grooves in the connection housing.

This expensive embodiment of the connecting housing prevents the economical manufacture of the plug connection.

THE INVENTION

In contrast thereto, the plug connection of the invention, has the advantage of avoiding the above mentioned deficiencies and of providing a plug connection which can be manufactured particularly simply and cost-effectively. For this purpose, the one-piece connecting element has at least one spring arm and one securing ring. Separate manufacture and testing of individual parts and their assembly is avoided in this way.

Since the plug connection is manufactured of plastic parts, it is of low mass and scarcely excited to sympathetic vibration, particularly with increases in vibration. For this reason, the plug connection can preferably by universally employed in motor vehicles.

It is possible to achieve an easily manipulated and securely operating connection and disconnection of the plug connection by means of the securing ring being formed as a polygon with defined resilient bending spots.

An advantageous ratio of the release path to the actuation path is achieved by the embodiment of the securing ring in the form of a regularly shaped polygon. A definite association between the actuation path and the release path, which are perpendicularly located in respect to each other, results.

A particularly reliable electrical plug connection is the result of making the contacts in the form of contact jacks and contact pins, each as a type of round contact.

A functionally secure seal of the plug connection can be achieved by means of the sealing elements described below.

Bulges on the first part perform a conducting function during the actuation of the plug connection because of a free space in the area of the grips, so that improper handling by untrained personnel is precluded, for example in case of maintenance operations on a motor vehicle, where this plug connection is preferably used.

DRAWINGS

FIG. 1 is a perspective cutaway view of the second part of the elements of the plug connection, FIG. 2 is a perspective cutaway view of the first part of the elements of the plug connection, FIG. 3 shows the seating of a contact in the second part in a partially sectional view.

DETAILED DESCRIPTION

Figure 1:
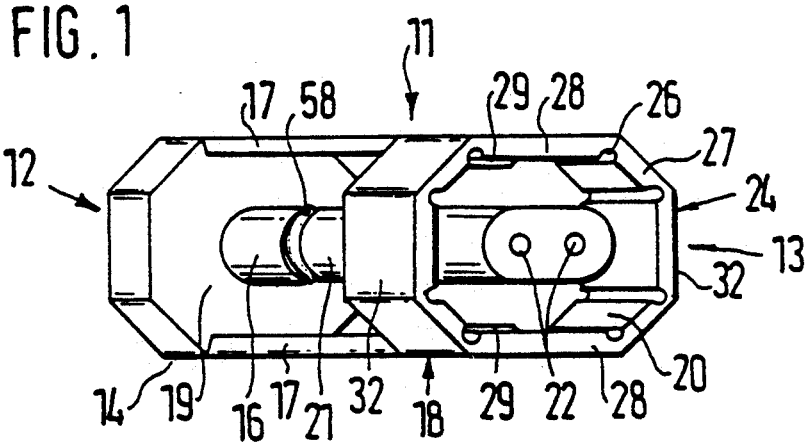

In FIG. 1 of the only exemplary embodiment, a second part 11, made of plastic to constitute the connecting part 11, is shown in a cutaway view as a part of an electrical plug connection. In the basic form, it has an approximately cylindrical shape, one end terminating in a connector side 12 and the other in a plug side 13.

As main components the connecting part 11 comprises a basic body 14, a contact support 16, two spring arms 17 and a securing ring 18.

The basic body 14 is approximately cylindrical and one end is closed by the connector side 12. The two spring arms 17, each of one piece, extend at right angles from an opposite end 19, from the center of which extends a contact support 21. The contact support 21 is in the form of a connector with an elliptical cross-sectional surface containing two contacts, placed on its large diameter, formed in the form of contact jacks 22 and extending in the longitudinal direction, i.e. from the plug side 13 to the connector side 12.

The two spring arms 17 are plate-shaped, are placed opposite each other and are oriented parallel to each other towards the diameter of the cross-sectional surface of the contact support 16. They extend with their ends facing away from the basic body 14 in one piece over the securing ring 18, the width of which extends from the connecting points at the spring arms 17 as far as the plug side 13 and the direction of circumference of which extends parallel to the front end 19.

The securing ring 18 has the shape of a closed polygon 24 with eight corner points 26 and a corresponding number of straight polygon lines 27. At the corner points 26, the wall thickness of the securing ring 18 is reduced in comparison with the straight polygon lines 27, so that squeezing deformation forces acting on the securing ring, 18 cause flexing or bending of the straight polygon lines 27 in the corner points 26 in the manner of an articulated lever.

The two spring arms 17 are each tied in one piece to one of the straight polygon lines 27. In this way these two straight polygon lines 27 are used as support elements 28.

The support elements 28 each have a locking shoulder 29 located opposite from and facing each other and attached on the sides of the support elements 28 facing the base body 14. The securing ring 18 and the contact support 16 end flush with the plug side 13.

The securing ring 18 has two grips 32, each offset at right angles in respect to the support elements 28 and each formed by a polygon line 27. These grips 32 are used for applying deformation forces.

Figure 2:
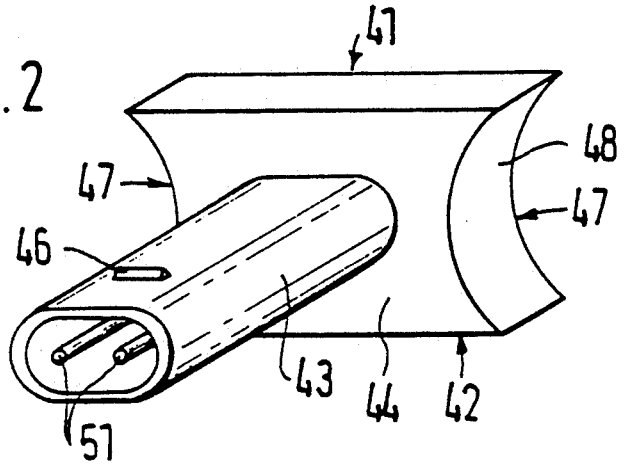

FIG. 2 illustrates a first part 41, which can be mounted with a connecting part 42, only schematically shown, on a device, not shown, for example a magnetic injection valve. It has a stub-shaped sleeve 43 extending from the connecting part 42. The sleeve 43 extends perpendicularly to a front face 44 of the first part 41; however, in other exemplary embodiments where, for example, the place of installation of the plug-and-socket unit is located in a hard-to-reach spot, it may also be inclined in relation to the front face 44.

The sleeve 43 has an elliptical cross-sectional surface which, in its dimensions, is adapted in such a way that it is possible to push the contact support 21 into the sleeve 43 and the securing ring 18 onto the sleeve 43, respectively, until the stop or locking shoulders 29 disposed on the contact support 16 come to rest on fixed stop shoulders or stationary detents 46 on the jacket of sleeve 43.

A continued joining movement of the connecting part 11 with the first part 41 becomes possible by the application of pressure forces to the grips 32 of the connecting part 11. In this way, the securing ring 18 can be sufficiently deformed in a spring-elastic manner until it comes to rest against the sleeve 43 and in such a way that the stop shoulder 29 of the securing ring 18 radially extend past the fixed stop shoulder 46 of the sleeve 43. In this way, the securing ring 18 can be axially displaced until it rests against the front face 44, so that, when the pressure on the grips 32 is released, the stop shoulders 29 of the securing ring 18 grip the fixed stop shoulder 46 of the sleeve 43 from behind, and the plug connection is secured in this manner.

In an alternative fashion, the stop shoulders 29, 46 can also be beveled on one side in such a way that the previously described joining movement can take place without putting pressure on the grips 32 and only by exerting an axially directed pressure on the connecting part 11 in the direction toward the first part 41. In this case, the one-sided beveling of the stop shoulders 29, 46 prevents that the disconnection of the plug connection can take place by only the exertion of an axial pressure in the opposite direction. Disconnection is only achieved by exerting pressure on the grips 32 in addition to exerting oppositely directed pressure which is sufficient to disengage the stop shoulders 29, 46 radially.

The side faces 47 of the first part 41 axially adjoining the grips 32 are each provided with a concave bulge 48 so that, because of this free space, the incorrect disconnection of the plug connector is prevented, even for the case where there are untrained personnel, for example in maintenance operations on a motor vehicle, where this plug connection is preferably used.

There are two longitudinally extending contacts in the form of cylindrical contact pins 51 inside the sleeve 43 which, on the one end, provide the electrical connection with the device and, on the other, extend into the contact jacks 22 of the connecting part 11, each forming an electrical contact, at least when the plug connection is locked.

Figure 3:
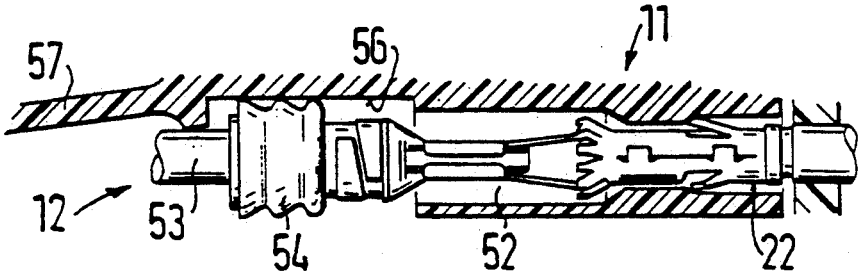

The seating of the contact jacks 22 in the connecting plug part 11 is shown in partial section in FIG. 3. For this purpose the connecting part 11 has a receiving chamber 52 for each contact jack 22, which extends through the entire length of the contact support 21 and the base body 14 of FIG. 1. The receiving chamber 52 is stepped in its long extension, each step having a circular cross-sectional surface.

One contact jack 22 each is inserted from the direction of the connector side 12 into the receiving chamber 52. In their position of operation the contact jacks are secured against axial displacement. This securing is provided by means of elements, not further described, for example expanding arms which are supported in a positively locking manner on the longitudinally extending steps in the receiving chamber 52. Each one of the contact jacks 22 is connected in an electrically conducting manner with an individual conductor 53 of a power supply.

The individual connector 53 is surrounded by a bellows-shaped, resilient individual connector seal 54 which radially presses on the one end against the individual connector 53 and on the other end against an interior wall 56 of the receiving chamber 52 and seals the interior of the plug connection. Sealing of the contact pins 51 in the first part 41 (FIG. 2) takes place in an analogous manner.

In the direction towards the connector side 12, the receiving chambers 52 are jointly enclosed by a socket 57 seated in the base body 14 (FIG. 1) and forming an axial extension of the receiving chamber 52. The transition point to a connecting line, not further shown, is located in the longitudinal extension of the socket 57, against which line the outer covering of the socket 57 rests tightly and resiliently to form a pre-seal of the plug connection and a protection against kinking of the connecting line.

A circumferential seal 58 in the shape of an O-ring is inserted into an annular groove of the contact support in accordance with FIG. 1 which, when the plug connection is joined, resiliently presses against the sleeve 43 and also seals the plug connection between the contact support 16 and the sleeve 43.

The plug connection contains coding elements, not further shown, which prevent the joining of the plug connection in more than one rotational position. These coding elements are realized by small asymmetrical changes in the shape of the securing ring 18 and the sleeve 43, for example.

Alternatively to the exemplary embodiment described, the cross-sectional surface of the contact support 21 and the cross-sectional surface of the sleeve 43 may also have a shape different from that of an ellipse. With a number of contacts of the plug connection other than two, an optimal distribution of space in respect to reduced exterior dimensions of the plug connection, on the one hand, and sufficient distance between the contacts, on the other, is preferably achieved by means of a circular cross-sectional surface. Furthermore, the contact pins 51 can also be disposed in the connecting part 11 and the contact jack 22 in the first part 41.

In the described plug connection, it is possible, by means of combining the characteristics of the individual connector seal 54, the radial seal 58, the embodiment of the contact pins 51 and contact jacks 22 as round contacts and the embodiment of the connecting part 11 with spring arms 17 and of the securing ring 18 as a one-piece plastic part, to provide a plug connection which can be cost-effectively manufactured and, at the same time, is reliable in operation.

Various changes and modifications may be made, and features described in connection with any one of the embodiments may be used with any of the others, within the scope of the inventive concept.

We claim:

1. An electrical plug connection having a first part (41), consisting of plastic, for receiving (22) plug-in contacts (51), and a second part (11), also consisting of plastic, the first part being formed with at least one detent (46), and the second part (11) having at least one locking shoulder (29) disposed on a resilient element (18) for said second part which, when the parts (11, 41) are plugged into each other, engages behind said detent (46), the resilient element (18) being deformable via an actuation portion (32) in such a way that the locking shoulder (29) on the resilient element (18) can be removed from an engaged position where it engages behind said detent (46), wherein the resilient element (17, 18) is made of plastic and has at least one spring arm (17) which is integrally formed with the second part (11), the spring arm (17) portion transitions in one piece into resilient element 18 which comprises a resiliently deformable securing ring, from the inside (20) of which ring the locking shoulder (29) extends inwardly and, in an undeformed state of said ring, engages behind said detent (46).

2. A plug connection in accordance with claim 1, characterized in that the spring element (17, 18) has two spring arms (17) located diametrically opposite each other in relation to the circumference of the securing ring (18), and the securing ring (18) has, on at least one annular surface thereof (24), the shape of a polygon (24) with corner points (26) of reduced wall thickness, so that the securing ring (18) can be deformed in the manner of a toggle lever.

3. A plug connection in accordance with claim 2, characterized in that the polygon (24) is regular and has an even number of corner points (26).

4. A plug connection in accordance with claim 1, characterized in that each one of the two spring arms (17) is connected on a polygon line (27) of the securing ring (18), and that these polygon lines (27) are located opposite each other to form support elements (28) and each support element supports at least one stop shoulder (29) oriented towards each other.

5. A plug connection in accordance with claim 4, characterized in that the second part (11) of the connecting part (11) has a stub-shaped contact support (16), the contact support (16) is enclosed by the securing ring (18) in such a way that it is possible to insert a sleeve (43) of the first part (41), having the detent (46) on the outer surface of the sleeve between the securing ring (18) and the contact support (16), and that between said sleeve and the securing ring (18), there is a distance which permits the deformation of the securing ring (18) which disengages its grip on the locking shoulder (29) from behind.

6. A plug connection in accordance with claim 5, characterized in that longitudinally extending contacts (22) are seated on a contact support (21).

7. A plug connection in accordance with claim 6, characterized in that the contact support (21) has the two contacts (22), which are formed as contact jacks (22) in the form of round contacts.

8. A plug connection in accordance with claim 1, characterized in that in the first part (41) the sleeve (43) includes fixed contacts (51), which can be connected to the contacts (22) of the connecting part (11).

9. A plug connection in accordance with claim 8, characterized in that the first part (41) has the two contacts (51), which are formed as contact pins (51) in the form of round contacts.

10. A plug connection in accordance with claim 1, characterized in that both the sleeve (43) and the contact support (21) have elliptical cross-sectional surfaces, that a radial seal (58) is inserted into an exterior annular groove of the contact support (21) which, when the plug connection has been joined, rests resiliently and sealingly on the outer face of the sleeve (43).

11. A plug connection in accordance with claim 1, characterized in that the securing ring (18) has grips (32), located opposite from each other, for applying deformation forces.

12. A plug connection in accordance with claim 11, characterized in that each one of the grips (32) is formed by a polygon line (27), and that these polygon lines (27) are each offset at a right angle in relation to support elements (28).

13. A plug connection in accordance with claim 12, characterized in that bulges (48) are formed on side faces (47) of the first part (41) which are axially adjacent to the grips (32) when the plug connection is joined.

14. A plug connection in accordance with claim 7, characterized in that each one of the contact jacks (22) is inserted from a connector side (12) of the second part (11) through a receiving chamber (52) and is fixed in the receiving chamber.

15. A plug connection in accordance with claim 14, characterized in that the contact jacks (22) are electrically connected with individual conductors (53) and the individual conductors (53) are connected with further conductors.

16. A plug connection in accordance with claim 15, characterized in that the individual conductors (53) extend out of the receiving chamber (52) and the second part (11) through a resilient individual conductor seal (54).

17. A plug connection in accordance with claim 1, characterized in that the plug-in contacts (51) are seated in the first part (41).

* * * * *